United States Patent [19]

Arai

[11] 4,416,557

[45] Nov. 22, 1983

[54] SERIAL PRINTER

[75] Inventor: Kenichiro Arai, Shiojiri, Japan

[73] Assignees: Epson Corporation, Nagano; Kabushiki Kaisha Suwa Seikosha, Tokyo, both of Japan

[21] Appl. No.: 278,141

[22] Filed: Jun. 29, 1981

[30] Foreign Application Priority Data

Jul. 3, 1980 [JP] Japan ..... 55-91055

[51] Int. Cl.[3] ..... B41J 7/48

[52] U.S. Cl. ..... 400/152; 101/93.17; 101/93.21; 101/93.37; 101/93.36; 101/93.19; 400/156.3; 400/163.3; 400/155.1

[58] Field of Search ..... 400/149, 150, 152, 156.3, 400/155.1, 156.2, 163.3, 158, 161, 331; 101/93.15, 93.17, 93.18, 93.19, 93.2, 93.21, 93.3, 93.36, 93.37, 93.41, 93.42

[56] References Cited

U.S. PATENT DOCUMENTS

| | | | |
|---|---|---|---|
| 962,082 | 6/1910 | Foote | 400/149 |
| 2,831,424 | 4/1958 | MacDonald . | |
| 2,843,243 | 7/1958 | Masterson | 101/93.19 |
| 2,949,846 | 8/1960 | Hoffman et al. . | |
| 3,077,256 | 2/1963 | Ruderfer | 101/93.19 |
| 3,351,007 | 11/1967 | Poland | 101/93.30 |
| 3,599,772 | 8/1971 | Comstock | 400/157 |
| 3,623,429 | 11/1971 | Imahashi et al. | 101/93.31 |
| 3,884,339 | 5/1975 | Castoldi et al. | 101/93.19 |
| 3,896,919 | 7/1975 | Hutley | 400/157 |
| 3,924,725 | 12/1975 | Kuhn et al. | 101/93.19 |
| 3,996,852 | 12/1976 | Matsuzawa | 101/93.31 |
| 3,998,312 | 12/1976 | Fujimi et al. | 101/93.19 |
| 4,043,439 | 8/1977 | Daly . | |
| 4,071,131 | 1/1978 | Turek et al. | 101/93.19 |

FOREIGN PATENT DOCUMENTS

| | | | |
|---|---|---|---|
| 191392 | 11/1907 | Fed. Rep. of Germany | 400/331 |

*Primary Examiner*—William Pieprz

*Attorney, Agent, or Firm*—Blum, Kaplan, Friedman, Silberman & Beran

[57] ABSTRACT

A serial printer for use in portable electronic calculators and the like. The printer includes a single printing head having a plurality of characters divided into two groups circumferentially disposed therearound in a predetermined pattern. A selecting mechanism includes two ratchet wheels. The teeth on one ratchet wheel correspond to the positioning of the characters in the first group of characters and the teeth on the other ratchet wheel correspond to the positioning of the characters in the second group of characters. The ratchet wheels are moveable between a first position in which the first set of teeth are operative and a second position where the second set of teeth are operative.

13 Claims, 11 Drawing Figures

FIG. 6
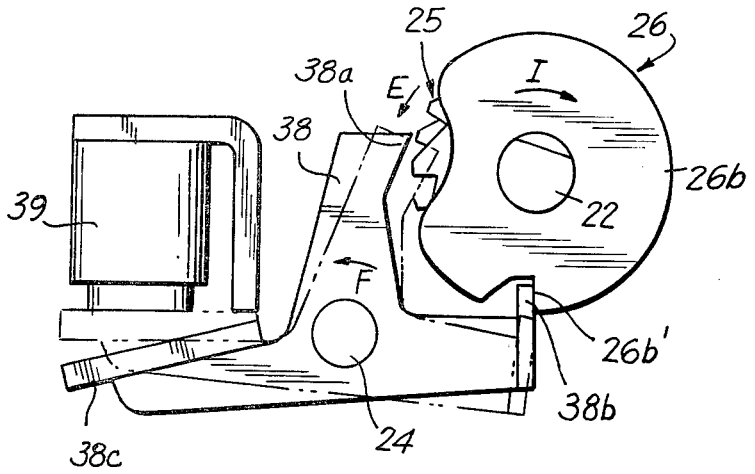
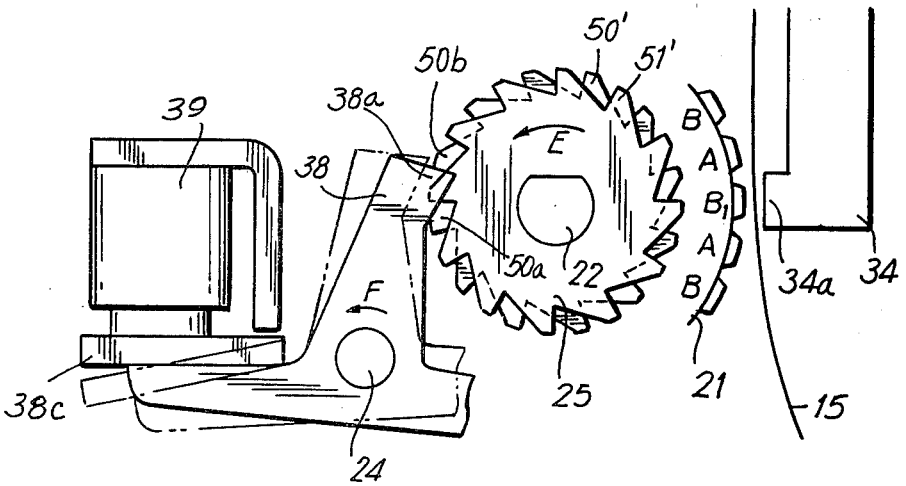
FIG. 7

SERIAL PRINTER

BACKGROUND OF THE INVENTION

This invention is directed to a serial printer and, in particular, to a serial printer suitable for use in hand-held portable electronic calculators or the like which includes a single printing head which carries two groups of characters alternately arranged thereon.

The printer operations performed by a serial printer which is typically used with portable electronic devices such as hand-held calculators or the like are generally performed such that a mathematical symbol, which indicates the operation performed, is printed in the first column on the printing tape and numerals are printed in the remaining columns on the printing tape. In the conventional printing method, a first type wheel which carries the symbols and a second type wheel which carries the numerals are provided such as is disclosed in Japanese Patent Laid-Open Publication No. 52-46930. In this type of printer having two type wheels, the symbols or numerals to be printed are selected by means of complex mechanisms.

In an alternative printing method, a single printing head carries both symbols and numerals on its outer circumference such as is disclosed in Japanese Patent Laid-Open Publication No. 51-112617. Such a printing method is advantageous in that the construction of the printer is simplified. However, this type of printer takes a relatively long time to select the necessary symbol or numeral to be printed and a large electromagnet is generally required in order to increase the printing speed. It is, of course, desirable to have a simple, inexpensively constructed printer for use in portable electronic calculators or the like. Accordingly, a serial printer for use especially in portable electronic calculators or the like which includes a single printing head which carries both symbols and numerals and which has a simplified construction and is inexpensive to manufacture, is desired.

SUMMARY OF THE INVENTION

Generally speaking, in accordance with the instant invention, a special printer adapted for use in portable electronic calculators or the like which includes a single printing head, is provided. The printer includes a printing head which is laterally translatable across the surface of a printing tape or paper. The printing head carries a first group of characters such as symbols and a second group of characters such as numerals which are disposed therearound in an alternating sequence. A ratchet mechanism having two ratchet wheels is provided. The first ratchet wheel has teeth which correspond to the positions of the first group of characters and the second ratchet wheel has teeth which correspond to the positions of the second group of characters. A selecting mechanism selects between either the first ratchet wheel or the second ratchet wheel for selecting one of the first and second groups of characters and for selecting a particular character to be printed in the group selected. A detecting mechanism may be provided which determines which particular character in the group selected is the one desired to be printed.

A relatively small electromagnet is provided in the printer to operate same which can be driven at a low voltage. The construction of the printer of the present invention is remarkably simplified over conventional printer constructions and hence is easy to manufacture. This results in a low manufacturing cost.

Accordingly, it is an object of the instant invention to provide an improved serial printer for use in portable electronic calculators or the like.

Another object of the instant invention is to provide an improved serial printer which includes a single printing head which carries both the numerals and symbols to be printed.

A further object of the instant invention is to provide a serial printer which is simplified in construction and inexpensive to manufacture.

Yet another object of the invention is to provide an inexpensive micro serial printer which uses a single printing head and has a high printing speed and simplified construction.

A still further object of the invention is to provide an improved serial printer having a single printing head carrying two groups of characters and a double ratchet mechanism which selects between the two groups of characters.

Another object of the invention is to provide an improved serial printer which has a low power consumption.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 6 is a right side elevational view, including a portion in phantom, of the printer selecting mechanism depicted in FIG. 3;

FIG. 7 is a right side elevational view, including a portion in phantom, of the printer selecting mechanism depicted in FIG. 3;

DESCRIPTION OF THE PREFERRED EMBODIMENTS

Figure 1:
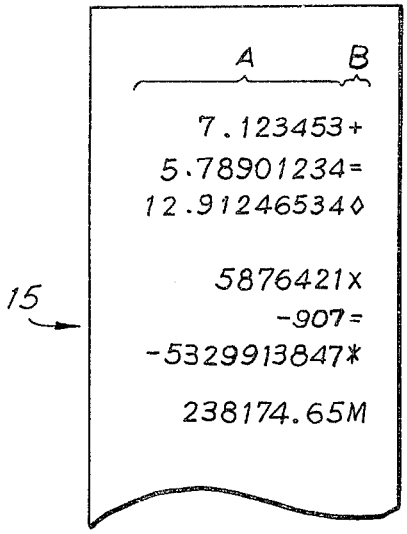
FIG. 1 is an example of a printing tape having characters such as numerals and symbols printed thereon as printed by a serial printer.

Reference is first made to FIG. 1 which depicts an example of a piece of printing paper or tape, generally indicated as 15. A serial printer in a portable calculator or the like prints numerals, decimal points, negative signs and the like in the columns indicated by the letter A. The printer prints mathematical or other symbols in the column indicated by the letter B which indicate the particular operation performed by the calculator on the numerals in section A on printing tape 15.

Conventional printers used in electronic calculators generally include a first printing head or wheel which carries the symbols to be printed in section B. The first printing head is generally stationary with respect to the printing tape since the symbols are only printed in the first (right) column. A second printing head or wheel carries the numerals, decimal point, negative sign and the like. The second printing head is laterally translatable across the printing tape so as to be able to print numerals in selected columns in section A on tape 15. The printing tape is advanced line by line for consecutive printing in rows thereon by the two printing wheels. Where two printing wheels are required as discussed above, a complex operating mechanism is required.

The present invention is particularly directed to a serial printer which includes a single print wheel which includes both the numerals and other marks which are printed in the columns in section A on printing tape 15 and the symbols which are printed in the first (right) column in section B.

Figure 2:
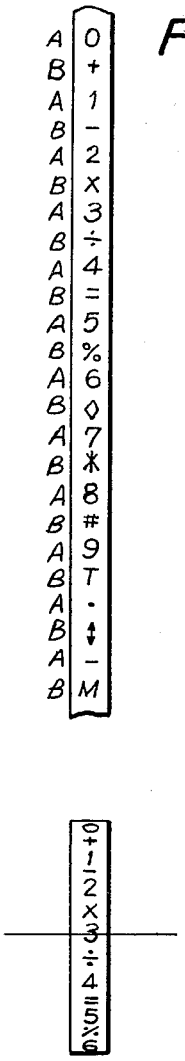
FIG. 2 depicts an example of the arrangement of characters including numerals and symbols on the printing head arranged in accordance with the present invention.
Figure 3:
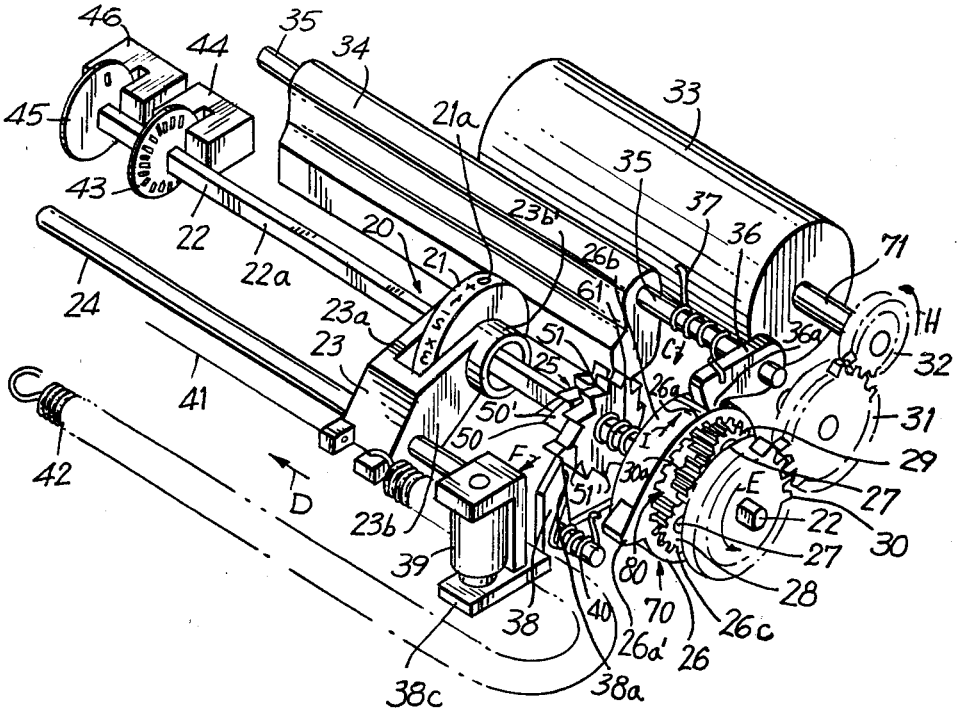
FIG. 3 is a perspective view, of a serial printer constructed and arranged in accordance with the instant invention.

FIG. 2 depicts a preferred arrangement of characters disposed on the print wheel used in the present invention, including both numerals and symbols. Reference letters A refer to the numerals and other mathematical indicia (decimal point and negative sign) which are printed in section A on tape 15 in FIG. 1. Reference letters B refer to the symbols which are printed in section B in the first (right) column on tape 15 in FIG. 1. The numerals and other indicia indicated by the letter A are alternatively disposed with the symbols designated by letter B so that a numeral, decimal point or negative sign is disposed in every other position with a symbol disposed in the alternating spaces between the numerals. It is noted that other arrangements of characters are possible in accordance with the invention.

Referring to FIGS. 3 through 6, the construction of the serial printer of the present invention will now be described. A printing head, generally indicated as 20, includes a cylindrical type wheel 21 which includes the characters to be printed. The characters are circumferentially disposed around type wheel 21 on rim 21*a* thereof. As aforenoted, with reference to FIG. 2, the characters which includes a group of numerals and a group of symbols are alternately disposed on rim 21*a* of type wheel 21. It is noted that in the embodiment depicted in FIG. 3, printing head 20 rotates in a vertical plane.

Type wheel 21 is axially supported on a selecting shaft 22 so as to be able to move therealong but is fixed on shaft 22 so as to rotate therewith. In this regard, shaft 22 may include a flat surface 22*a* and type wheel 21 may include a correspondingly shaped opening therein so that type wheel 21 can slide along shaft 22 but not be rotatable with respect thereto.

Type wheel 21 is mounted between arms 23*a* and 23*b* of a carriage 23. Arm 23*b* includes a collar or flange 23*b*′ which extends therefrom. Carriage 23 is slidably supported by selecting shaft 22 and a guide shaft 24.

A selecting ratchet mechanism 25 is axially supported on selecting shaft 22 so as to be movable therealong but is fixed on shaft 22 so as to rotate therewith. Selecting ratchet mechanism 25 includes two adjacent ratchet wheels 50 and 51. Ratchet wheel 50 includes teeth 50′ and ratchet wheel 51 includes teeth 51′. Teeth 51′ are spaced so as to correspond to the position of the characters in group A on type wheel 21. Teeth 50′, on the other hand, are spaced so as to correspond to the position of the characters in group B on type wheel 21. Ratchet wheel 25 is urged in the direction of arrow D by the force exerted by compression spring 61.

A differential gear mechanism is generally indicated at 70. Differential gear mechanism 70 includes a printing cam 26 which is supported by shaft 22 through a central opening 26′. Printing cam 26 includes an internal gear 26*c* around the inner circumference thereof. The outer circumference of printing cam 26 includes a cam portion 26*a* having a cam 26*a*′ and a notched portion 26*b* having a notch 26*b*.

Differential gear mechanism 70 also includes a planet gear mechanism, generally indicated at 80 disposed in printing cam 26. Planet gear mechanism 80 includes planet gears 28 and 29 which are rotatably coupled 180° apart to a planet lever 27. Planet gears 28 and 29 are meshingly engaged with internal gear 26*c*. Planet lever 27 is fixedly secured to shaft 22 so as to be rotatable therewith. A drive gear 30 supported by shaft 22 includes a sun gear 30*a* fixed thereto which is meshingly engaged with planet gears 28 and 29.

Gear 30 is meshingly engaged with a gear 31 which in turn is meshingly engaged with a gear 32 which together form the transmission drive of the printer. Gear 32 is secured to a drive shaft 71 of a motor 33 which rotates gear 32 in the direction of arrow H to drive the aforedescribed gear train.

A printing hammer or platen 34 is arranged proximate type wheel 21 and extends along the path of printing. Platen 24 is fixedly secured to a hammer shaft 35. A printing lever 36 which is secured to end 35*b* of hammer shaft 35 is spring biased by a torsion spring 37 in the direction indicated by arrow C. Spring 37 biases printing lever 36 so that end 36*a* thereof is biased against cam portion 26*a* of printing cam 26.

A selecting pawl 38 is pivotally coupled to guide shaft 24 and includes a pawl portion 38*a* which meshes with selecting ratchet wheel 25, an engagement portion 38*b* which engages with notch 26*b*′ of printing cam 26 and an attracting (armature) portion 38*c* which lies proximate an electromagnet 39. Selecting pawl 38 is normally urged in the direction of arrow F by a torsion spring 40. However, upon activation of electromagnet 39, attracting portion 38*c* is attracted to magnet 39 so that pawl 38 pivots in a direction opposite to that of arrow F to the position depicted in FIG. 7 which is also shown in phantom in FIG. 6.

A wire 41 is joined to carriage 23 which selectively pulls carriage 23 by means of a winding drum or the like (not shown) in the direction of arrow D in order that print wheel 21 can print across lines on the printing paper. A return spring 42 is joined at one end thereof to carriage 23 and pulls carriage 23 in a direction opposite to that indicated by arrow D so as to return carriage 23 to its standby or start position (FIG. 4) after the force exerted by wire 41 is released.

A detecting disc 43 is secured to shaft 22 for rotation therewith and cooperates with a detector 44 in order to generate timing signals representative of the position of the characters on type wheel 21. A second detecting disc 45 is secured to selecting shaft 22 for rotation therewith and cooperates with a second detector 46 to generate a home position signal which indicates when the first character ("0") on type wheel 21 is in its home (reset) position.

The operation of the serial printer of the present invention will now be described. When the force exerted by wire 41 is released, return spring 42 returns carriage 23 and hence print head 20 to the standby position depicted in FIG. 4. Carriage 23 is reset by a carriage returning signal and carriage 23 is moved in the direction opposite to that indicated by arrow D by the force of return spring 42 so that collar **23*b*' on carriage 23 presses selecting ratchet mechanism 25 in the direction opposite to arrow D until ratchet wheel 51 abuts against a side frame 49 of the printer. Since the force exerted on carriage 23 by return spring 42 is stronger than the force exerted by spring 61 on ratchet mechanism 25, spring 61 is compressed so that ratchet mechanism 25 abuts against frame 49. At this time, if the pawl portion 38*a* of selecting pawl 38 is meshed with teeth 50' of ratchet wheel 50, a character from group B will face portion 34*a* of printing hammer 34**.

Engagement portion **38*b* of selecting pawl 38 normally engages with notch 26*b*' of printing cam 26 as depicted in FIG. 6 so as to stop the rotation of printing cam 26. When drive shaft 71 of motor 33 rotates in the direction of arrow H, sun gear 30*a* is rotated in the direction of arrow E through the rotation of transmission gears 30, 31 and 32. Since printing cam 26 is stopped from rotating by selecting pawl 28, planetary gears 28 and 29 will roll around internal gear 26*c* to thereby swing planet lever 27 in the direction of arrow E. When planet lever 27 is rotated, selecting shaft 22 fixed thereto is rotated in the direction of arrow E so that type wheel 21, selecting ratchet mechanism 25 and detecting discs 43 and 45** are rotated.

Figure 4:
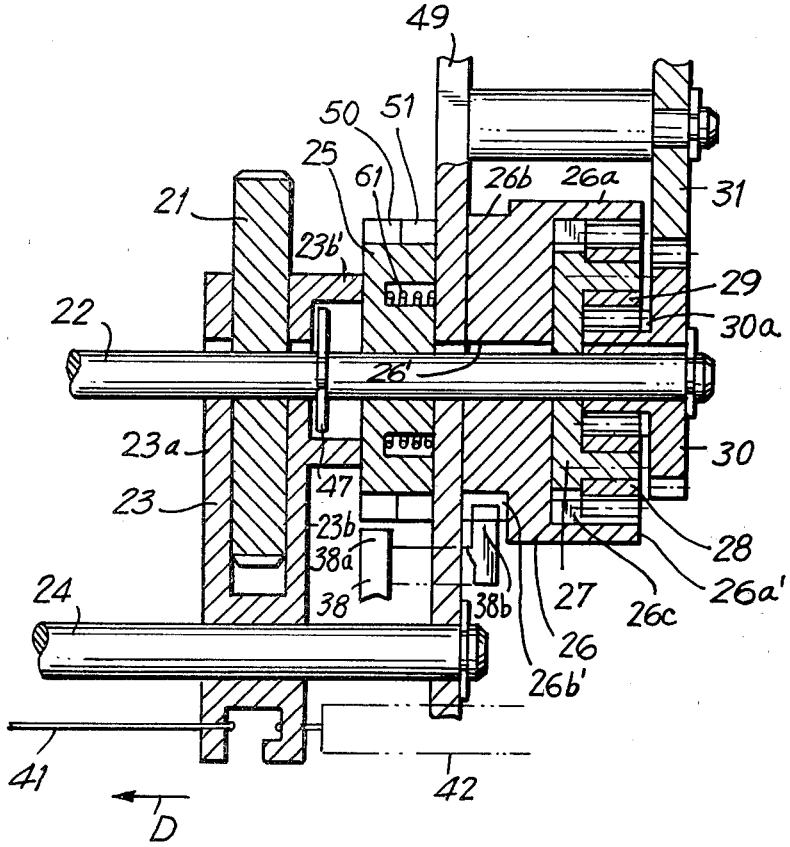
FIG. 4 is a top plan sectional view of the printing mechanism depicted in FIG. 3 in the start position.

When print head 20 is in the start (right) position depicted in FIG. 4, collar **23*b*' on carriage 23 will press ratchet mechanism 25 against frame 49. At this time, pawl 38*a* on selecting pawl 38 will be in alignment with ratchet wheel 50. The teeth 50' on ratchet wheel 50 are positioned so as to correspond to the alternate positioning of the characters in group B. That is to say that when any of teeth 50' are engaged to pawl 38*a*, one of the characters from group B will face printing hammer 34**.

On the other hand, when printing head 20 is in any other position that the start position, spring 61 will bias ratchet mechanism against a stop 47 fixed to shaft 22 so that pawl **38*a* is in alignment with ratchet wheel 51. The teeth 51' on ratchet wheel 51 are offset (FIGS. 7 and 8) from the teeth 50' on ratchet wheel so as to correspond to the alternate positioning of the characters in group A. When any of the teeth 51' are engaged to pawl 38*a*, one of the characters from group A will face printing hammer 34**.

An example where the "+" symbol in column B on printing tape 15 (FIG. 1) is printed, will now be described with reference to FIGS. 7 and 9. A timing signal $T_1$ is generated when selecting ratchet mechanism 25 is rotated so that tooth **50*b* is at the position depicted in FIG. 7. If electromaget 39 is energized at this time in response to timing signal $T_1$, selecting pawl 38 is pivoted in the direction opposite to arrow F so that pawl portion 38*a* thereof is brought into meshing engagement with tooth 50*b* to thereby stop the rotation of selecting ratchet wheel 25. This will also stop the rotation of selecting shaft 22 and type wheel 21. At this time, character $B_1$ from group B which is positioned to face extension 34*a* of printing hammer 34**. In the example under discussion, $B_1$ is the "+" symbol.

When selecting pawl 38 is swung in the direction opposite to arrow F into engagement with ratchet wheel 50, its engagement portion **38*b* is disengaged from notch 26*b*' of printing cam 26, as shown in phantom in FIG. 6, so that printing cam 26 is free to rotate. Since planet lever 27 is prevented from rotating at this time, the rotary motion of sun gear 30*a* is transmitted through planetary gears 28 and 29 to internal gear 26*c*. Hence, printing cam 26 rotates in the direction of arrow I. When printing cam 26 rotates, cam 26*a*' thereon presses against printing lever 36. This causes hammer shaft 35 and printing hammer 34 to pivot in the direction opposite to that of arrow C so that extension 34*a* of printing hammer 34 is depressed against character $B_1$ so that character $B_1$, which is the "+" symbol, is printed on printing paper 15. A lead or smooth area is formed in printing cam 26 so that the printing of character $B_1$ is completed upon one-half rotation of printing cam 26, printing lever 36** thereafter resting against the lead during the other one-half revolution.

Figure 5:
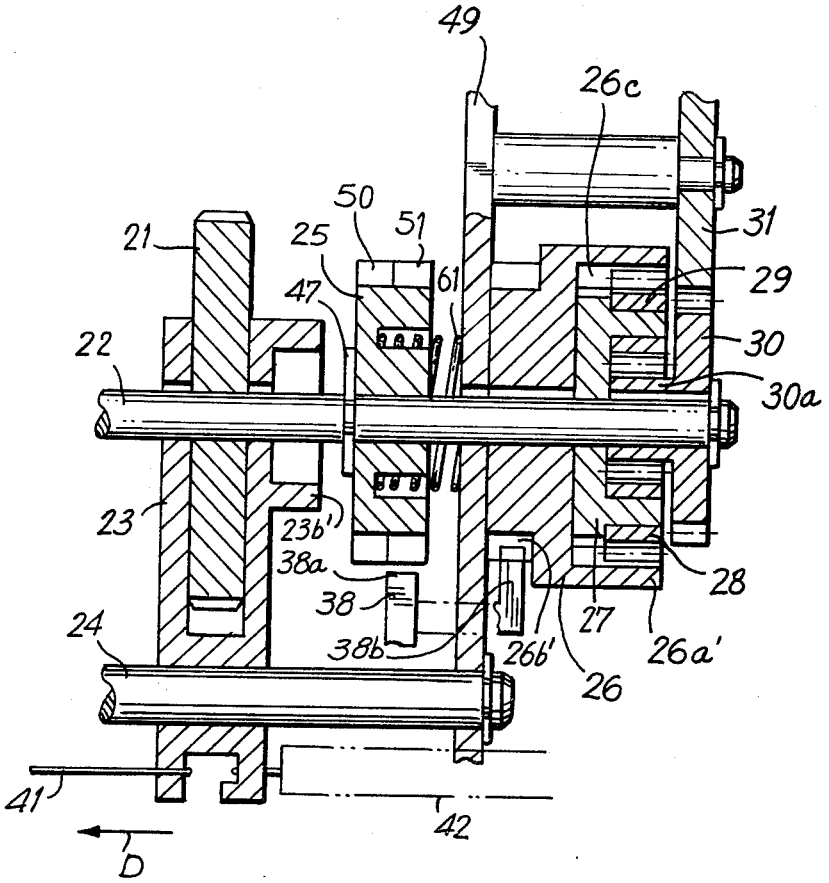
FIG. 5 is a top plan sectional view of the printing mechanism depicted in FIG. 3 after the printing head has moved from its start position.

The power supplied to electromagnet 39 is continued between $T_1$ and $T_3$ until selecting pawl 38 engages with ratchet wheel 50 so that printing cam 26 starts to rotate. On the other hand, these timing signals are not generated during the printing process itself since detecting discs 43 and 45 are stopped from rotating when selecting shaft 22 is stopped. The symbol "++ is printed in the first column, and carriage 23 moves one position in the direction of arrow D as depicted in FIG. 5.

While printing cam 26 continues rotating, wire 41 is wound by a winding drum (not shown) so that carriage 23 is shifted one position in the direction of arrow D to thereby be in position to print the next character. After printing cam 26 has completed one rotation, engagement portion **38*b* of selecting pawl 38 is again brought into engagement with notch 26*b*' of printing cam 26 by the action spring 40 so that printing cam 26** is stopped from rotating.

At this time, meshing portion **38*a* of selecting pawl 38 is disengaged from selecting ratchet mechanism 25 so that selecting ratchet mechanism 25, selecting shaft 22, type wheel 21 and planet lever 27 restart their respective rotations. When carriage 23 moves, selecting ratchet mechanism 25 is moved in the direction of arrow D by the action of spring 61 until it abuts against stop 47 which prevents its further lateral movement. At this time, teeth 51' of ratchet wheel 51 are positioned so as to be engagable with selecting pawl 38**.

Figure 8:
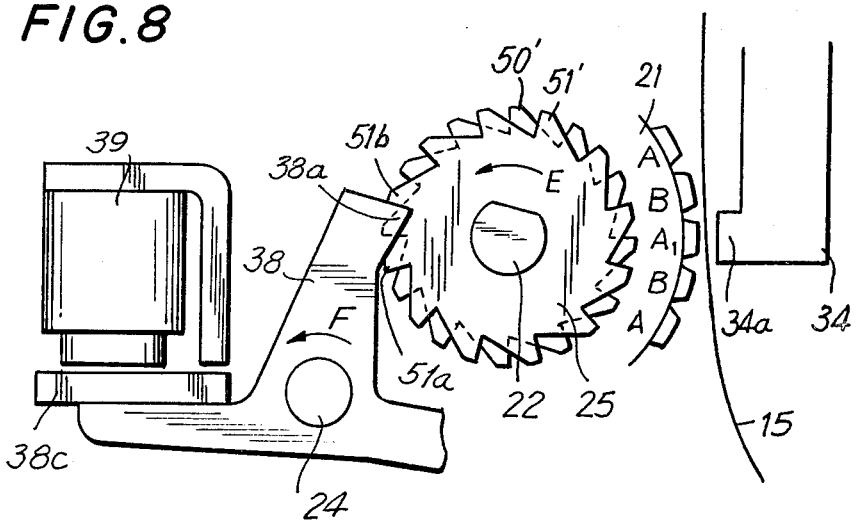
FIG. 8 is a right side elevational view showing a development of the printer selecting mechanism depicted in FIG. 7.
Figure 9:
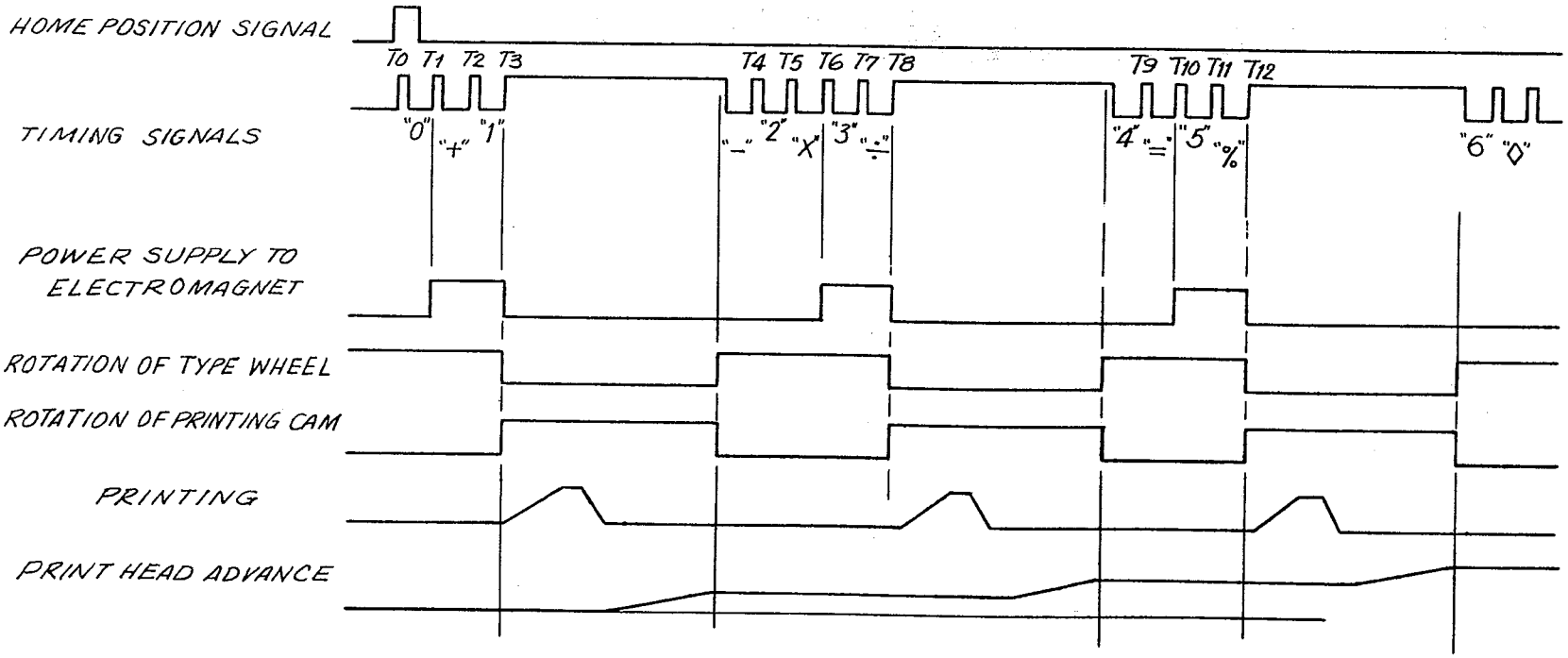
FIG. 9 is a timing chart which illustrates the timing signals applied to the printer depicted in FIG. 3.

Referring now to FIGS. 8 and 9, an example where the numeral "3" is to be printed in the second column will now be described. Similar to the aforedescribed selecting and printing operations, selecting ratchet mechanism 25 is rotated in the direction of arrow E until it comes into the position depicted in FIG. 8 where tooth **51*b* is ready to be engaged by selecting pawl 38. A timing signal $T_6$ is generated. When the electromagnet 39 is activated in response to timing signal $T_6$, selecting pawl 38 is pivoted in the direction opposite to that of arrow F to bring its pawl portion 38***a* into engagement with tooth 51*b* so that selecting ratchet mechanism 25, selecting shaft 22 and type wheel 21 are stopped from rotating. At this time, character $A_1$ from group A is positioned to face extension 34*a* of printing hammer 34. In this example, $A_1$ is the numeral "3" selected from the group of characters A.

In order to print character $A_1$, printing cam 26 is rotated as described above by the action of differential gear mechanism 70 to thereby effect the printing operation. The carriage is moved one column so that the selecting and printing operations for the third character are ready.

Since selecting ratchet mechanism 25 is urged in the direction of arrow D by the action of spring 61, teeth 51 thereon are always positioned in alignment with selecting pawl 38 so that only the characters from group A are printed in every column other than the first (right) column. The selecting, printing and carriage moving operations are repeated until the entire number is printed. Then, the winding drum is reset by a carriage returning signal so that carriage 23 is moved in the direction opposite to that of arrow D by the force of return spring 42 until the carriage returns to its stand-by or start position. At this time, printing paper 15 is fed one line by a conventional paper advancing mechanism in order to prepare the next line for printing.

As described herein, although type wheel 21 carries 24 different characters on its outer circumference as depicted in FIG. 2, it operates as two type wheels each carrying 12 characters. As a result, the time period for applying the power to the electromagnet can be preset so that it is equal to the time period when two type wheels are used. A high printing speed can be obtained without using a large electromagnet driven by a high current. Moreover, since a single type wheel is required in the present invention, the construction is simplified and the size of the printer is reduced.

Although the present invention has been described with reference to a single type wheel which is used in the printing head which rotates in a vertical direction, the present invention is not limited thereto. In my copending application entitled SERIAL PRINTER and filed on even date, another embodiment of the serial printer described herein is disclosed.

Figure 10:
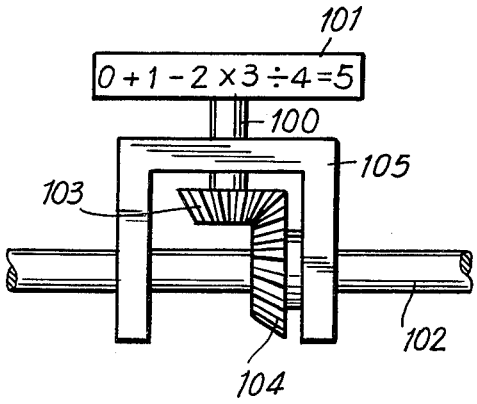
FIGS. 10 and 11 depict alternative embodiments of the present invention.

A variety of other modifications are possible. For example, referring to FIG. 10, a type wheel 101 is supported on a carriage 105 by means of an axle 100. A bevel gear 104 is fixed on selecting shaft 102 and a corresponding bevel gear 103 is fixed to axle 100 so as to be meshingly engaged with bevel gear 104. This arrangement allows printing wheel 101 to rotate in a horizontal plane with the axis of rotation perpendicular to that of selecting shaft 102.

Figure 11:
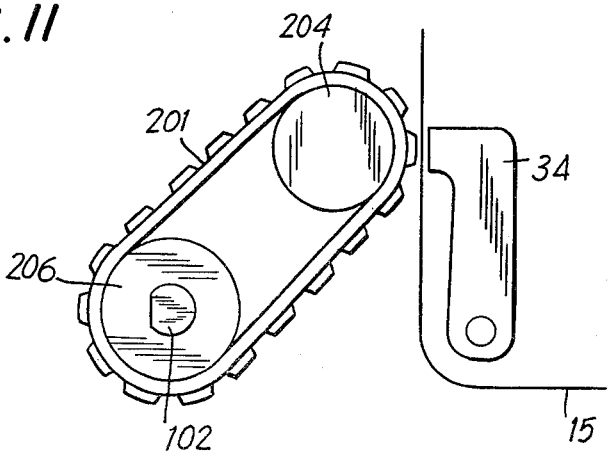

In another embodiment as depicted in FIG. 11, an endless belt 201 can be supported between two rollers 204 and 206. The outer surface of belt 201 can carry the two groups of characters. Selecting shaft 102 extends through roller 206 so as to rotate belt 201 in order to selectively position the characters in front of printing hammer 34.

With respect to the selecting mechanism described herein, the selecting ratchet wheel is moved between the two positions as discussed above to interchange between the characters in group A and the characters in group B. However, a similar result can be obtained if the selecting pawl is moved between the two positions while holding the selecting ratchet wheel stationary. Moreover, if two sets of selecting pawls and electromagnets are arranged and selectively driven, the characters of both groups A and B can be printed at each position. Finally, although the present invention has been described by using a differential gear mechanism for interchanging the characters to be printed, it should not be construed as limited thereto.

According to the present invention, since the characters are divided into a first group of characters such as symbols and a second group of characters such as numerals which are alternately arranged with respect to each other on the outer circumference of a single type wheel, this single type wheel can be controlled substantially similar to the construction in which two type wheels are used. Thus, the time period for applying power to the electromagnet can be elongated without decreasing the printing speed and so that a drive at a low voltage and in a low current can be effected by the use of small electromagnet. Moreover, since it is sufficient to use a single type wheel, the construction is remarkably simplified with the added effect that a small and inexpensive micro serial printer for a hand-held portable electronic calculator or the like is provided.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A serial printer for printing characters on a printing tape comprising a frame, a selecting shaft rotatably supported on said frame and motor means for rotating said selecting shaft, a printing head slidably supported on said selecting shaft for rotation therewith, said printing head having a first group of characters and at least a second group of characters alternately disposed thereon, a first ratchet rotatably supported on said selecting shaft and associated with said first group of characters, a second ratchet rotatably supported on said selecting shaft and associated with said second group of characters, said first ratchet having a plurality of first teeth, each of said first teeth corresponding in position to a given one of said characters in said first group of characters, said second ratchet having a plurality of second teeth, each of said second teeth corresponding in position to a given one of said characters in said second group of characters, pawl means pivotally supported on said frame for selective engagement with the teeth on one of said first and second ratchets, said first and second ratchets being slidably supported on said selecting shaft and being movable between a first position where said first teeth are in alignment with said pawl means for selective engagement therewith and a second position where said second teeth are in alignment with said pawl means for selective engagement therewith, said pawl means selectively engaging one of said first and second teeth after one of said first and second groups has been selected, electromagnet means for selectively pivoting said pawl means, said pawl means, when pivoted by said electromagnet means, engaging one of the teeth on one of said first and second ratchets to stop the rotation of said selecting shaft so that the character on said printing head corresponding to the tooth selected by said pawl means can be printed on said printing tape, said selecting shaft including first biasing means for biasing said first and second ratchets in said second position, a first bevel gear slidably supported on said selecting shaft for rotation therewith and a second bevel gear mounted on said printing head in meshing engagement with said first bevel gear, a printing mechanism including printing cam means coupled to said selecting shaft for printing the character selected by said pawl means on said printing tape, said printing cam means including planet gear mechanism having a planet lever secured to said selecting shaft, said planet lever having at least one planet gear rotatably secured thereto, said printing cam means having an internal gear which meshingly engages with said planet gear, said motor means including a sun gear driven thereby which is meshingly engaged with said planet gear, said pawl means including engagement means which selectively prevents said printing cam means from rotating, said planet gear mechanism further rotating said selecting shaft when said engagement means prevents said printing cam means from rotating, said pawl means including second biasing means for biasing said pawl means in a third position where said engagement means is engaged with said printing cam means, the activation of said electromagnet means moving said pawl means into a fourth position where said pawl means meshes with the teeth on one of said first and second ratchets and said engagement means is released from said printing cam means, said print mechanism including printing hammer means pivotally coupled to said frame for pressing said printing tape against the character selected to be printed by said pawl means, and lever means coupled to said printing hammer means for pivoting same, said printing cam means pivoting said lever means when said pawl means is engaged with the teeth on one of said first and second ratchets.

2. The serial printer, as claimed in claim 1, wherein said printing head includes a single type wheel having an outer circumference, said characters in said first and second groups being alternately disposed on the outer circumference of said type wheel.

3. The serial printer, as claimed in claim 2, wherein said type wheel is slidably supported on said selecting shaft so as to rotate in a plane substantially perpendicular to said selecting shaft.

4. The serial printer, as claimed in claim 1, wherein said printing head includes an endless belt having an outer surface slidably supported by said selecting shaft for rotation thereby, said characters in said first and second groups being alternately disposed on the outer surface of said belt.

5. The serial printer, as claimed in claim 1, wherein said printing head is laterally translatable across said printing tape in a plurality of steps for printing characters in a plurality of columns across said printing tape.

6. The serial printer, as claimed in claim 5, wherein said printing head includes positioning means for positioning said first and second ratchets in their first position when said printing head is in at least one said plurality of steps.

7. The serial printer, as claimed in claim 1, further comprising detecting means for detecting the position of each said character with respect to said printing tape.

8. The serial printer, as claimed in claim 7, wherein said detecting means includes a disk means secured to said selecting shaft for detection of the orientation of said selecting shaft.

9. A serial printer for printing characters on a printing tape comprising a frame, a selecting shaft rotatably supported on said frame and motor means for rotating said selecting shaft, a printing head slidably supported on said selecting shaft, said printing head having a first group of characters and at least a second group of characters alternately disposed thereon, a first ratchet rotatably supported on said selecting shaft and associated with said first group of characters, a second ratchet rotatably supported on said selecting shaft and associated with said second group of characters, said first ratchet having a plurality of first teeth, each of said first teeth corresponding in position to a given one of said characters in said first group of characters, said second ratchet having a plurality of second teeth, each of said second teeth corresponding in position to a given one of said characters in said second group of characters, pawl means pivotally supported on said frame for selective engagement with the teeth on one of said first and second ratchets, said pawl means selectively engaging one of said first and second teeth after one of said first and second groups has been selected, said first and second ratchets being displaceable between a first position where said first teeth are in alignment with said pawl means and a second position where said second teeth are in alignment with said pawl means, print means for printing the character corresponding to the tooth selected by said pawl means on said printing tape, said printing head being laterally translatable across said printing tape in a plurality of steps, said printing head including positioning means for positioning said first and second ratchets in their first position, said positioning means including an axially extending member, said extending member pressing said first and second ratchets against said frame so that said first and second ratchets are in their first position when said printing head is in at least one said plurality of steps.

10. The serial printer, as claimed in claim 9, wherein one of said steps is a start step where said printing head prints in a first column, said extending member pressing said first and second ratchets against said frame when said printing head is in said start step so that said first group of characters is selected.

11. The serial printer, as claimed in claim 10, wherein said selecting shaft includes first biasing means for biasing said first and second ratchets in said second position, said extending member being released from said first and second ratchets so that said first and second ratchets are displaced to their second position by said first biasing means at the other of said steps.

12. The serial printer, as claimed in claim 11, wherein said first teeth are offset with respect to said second teeth so that said first teeth correspond in position to said first group of characters and said second teeth correspond in position to said second group of characters.

13. The serial printer, as claimed in claim 12, further comprising detecting means for detecting the position of each said character and for producing a signal representative of the position detected in response thereto.

* * * * *